US005524567A

United States Patent [19]

Astley et al.

[11] Patent Number: 5,524,567

[45] Date of Patent: Jun. 11, 1996

[54] TRIMMING DEVICE FOR A WATER BORNE VESSEL

[76] Inventors: Dale V. Astley; Carl W. Astley, both of Bona House, Abergele Road, Llanddulas, Clwyd LL22 8HP, Wales

[21] Appl. No.: 382,924

[22] Filed: Feb. 3, 1995

[30] Foreign Application Priority Data

Feb. 8, 1994 [GB] United Kingdom ..... 9402397

[51] Int. Cl.[6] ..... B63H 9/04

[52] U.S. Cl. ..... 114/286

[58] Field of Search ..... 114/275, 279, 114/280, 284, 285, 286, 287

[56] References Cited

U.S. PATENT DOCUMENTS

| | | | |
|---|---|---|---|
| 1,301,917 | 4/1919 | Bolotoff | 114/279 |
| 3,200,782 | 8/1965 | Walden et al. | 114/285 |
| 3,565,030 | 2/1971 | Curtis | 114/285 |
| 5,311,832 | 5/1994 | Payne | 114/280 |

FOREIGN PATENT DOCUMENTS

| | | |
|---|---|---|
| 1178421 | 1/1970 | United Kingdom . |
| 1249359 | 10/1971 | United Kingdom . |

*Primary Examiner* Jesus D. Sotelo
*Attorney, Agent, or Firm* Anthony J. Casella; Gerald E. Hespos

[57] ABSTRACT

A trimming device for a water borne vessel comprising a trim tab which is adapted to be pivotally mounted to the vessel so as to be at least partially submerged in use, at an inclination such that, upon forward movement of the vessel, the tab is subjected to pressure from the water flowing over it, resulting in lift of the vessel, and a control mechanism which acts on the trim tab to automatically allow its inclination to reduce progressively and hence to correspondingly reduce the lift on the vessel.

18 Claims, 7 Drawing Sheets

TRIMMING DEVICE FOR A WATER BORNE VESSEL

The present invention relates to the trimming of a water borne vessel, and in particular to a trimming device intended to maintain a water borne vessel at a preferred attitude and to promote planing.

A number of factors can cause the attitude of a water borne vessel to change in pitch (i.e. cause the bow to rise relative to the stern, or vice versa). These factors include:

i. changes in the position of the center of gravity of the water borne vessel caused, for example, by the masses of articles or crew on board;

ii. hydrodynamic forces exerted on the exterior of the hull of the water borne vessel as a result of its motion.

Many water borne vessels are designed to operate in two regimes:

i. at low speeds, the hull displaces a mass of water substantially equal to the mass of the water borne vessel;

ii. at higher speeds, a significant proportion of the water borne vessel's mass is supported by a hydrodynamic effect of water flowing under and around the water borne vessel, so that it rises in the water and displaces a mass of water which is less than its own mass.

This second regime is known as planing. It is often accompanied by a change in pitch. When accelerating, but not yet planing, some water borne vessels adopt an attitude in which the bow is raised, so that the stern moves down and digs into the water, causing an increase in drag. Some vessels adopt a bow up attitude even when planing. In the case of dinghies with outboard motors, for example, it is common practice to carry a passenger in the bow solely to prevent the bow rising when moving fast.

These attitude changes are undesirable for several reasons:

i. they may cause passenger discomfort;

ii. they may render the water borne vessel unstable;

iii. they may prevent the helmsman from seeing forwards;

iv. they may increase drag, so reducing fuel efficiency, acceleration and top speed; and v. if the attitude of the water borne vessel is not optimal, it may require a higher speed to be attained before it begins to plane.

To overcome the above (and other) problems, it is known to provide trim tabs at a submerged portion of the hull of a vessel. These commonly take the form of a pair of generally planar trim tabs, hingedly attached to the transom at the stern of the hull. The angle of the trim tabs may be varied by means of a hydraulic ram to dynamically compensate for changes of attitude.

An additional function of the trim tabs is to promote planing of the water borne vessel. When the vessel is accelerating, and before it begins to plane, the trim tabs are angled downwards, making a large angle of attack to the water flowing over them and so generating lift at the stern. This lift not only helps to maintain the correct attitude by preventing the bow rising, it also helps to raise the hull in the water and so enables planing to begin.

Although power actuated trim tabs are effective, their cost, complexity and relative slow speed of operation makes them inappropriate for many applications. For example, on vessels below 5 meters in length the expense of such a system is rarely considered worthwhile.

Accordingly, it is an object of the present invention to provide a fast acting trimming device for a water borne vessel which promotes planing and can act to maintain a preferred attitude, and which is simple and robust, both in operation and installation.

According to the present invention, there is provided a trimming device for a water borned vessel comprising a trim tab which is adapted to be pivotally mounted to the vessel so as to be at least partially submerged in use, and a control mechanism which acts on the trim tab, wherein an initial inclination of the trim tab is such that, upon forward motion of the vessel, the trim tab is subjected to pressure by water flowing over it, which results in lift on the vessel and tends to reduce the inclination of the tab, and the control mechanism automatically allows the inclination to reduce gradually under the influence of said pressure.

The trimming device generates lift, and automatically adjusts the amount of lift generated, without the use of any powered means of adjustment.

In a further preferred embodiment, the control mechanism comprises a cylinder and a ram, the ram comprising a piston which is slidably accommodated in the cylinder.

Specific embodiments of the present invention will now be described, by way of example only, with reference to the accompanying Figures, in which:

FIG. 1 is a longitudinal section through a first embodiment of a trimming device in accordance with the present invention shown in its operational position mounted on the hull of a vessel;

FIGS. 1*a* and 1*b* show modifications of the embodiment of FIG. 1;

Figure 1:
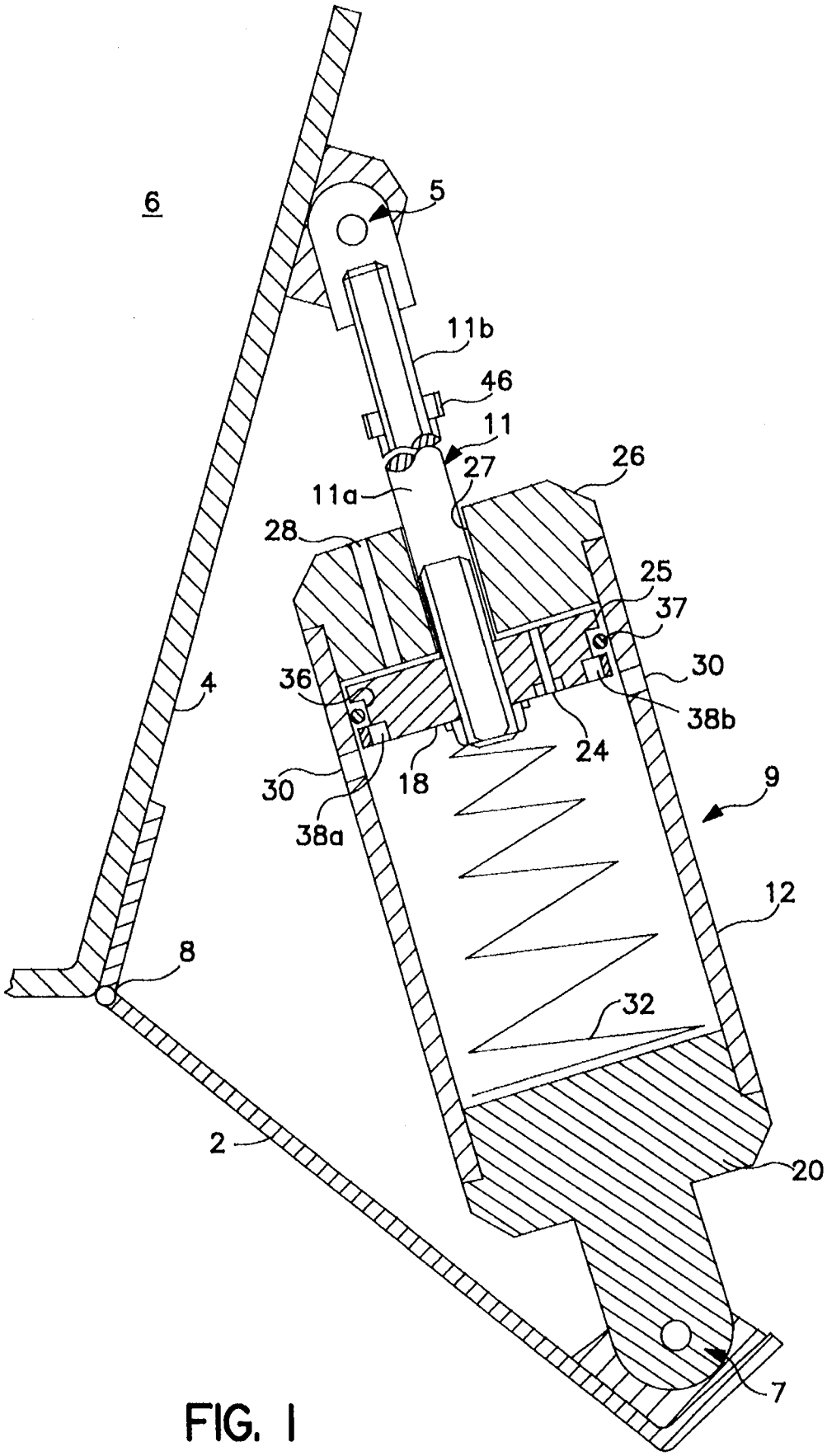
Figure 1B:
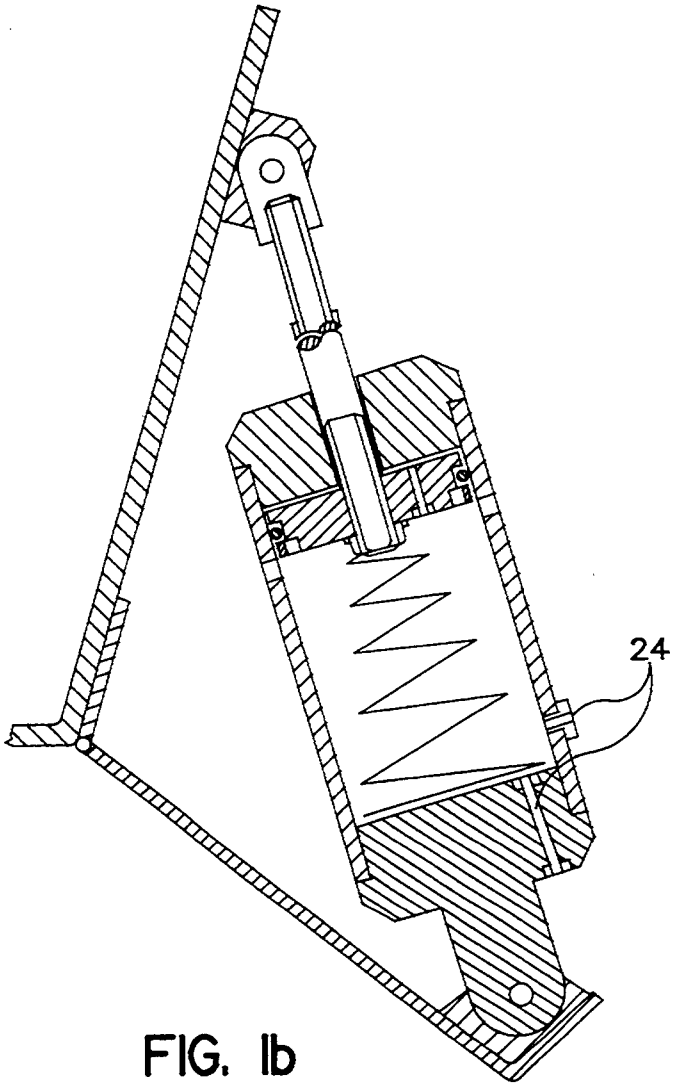
Figure 6A:
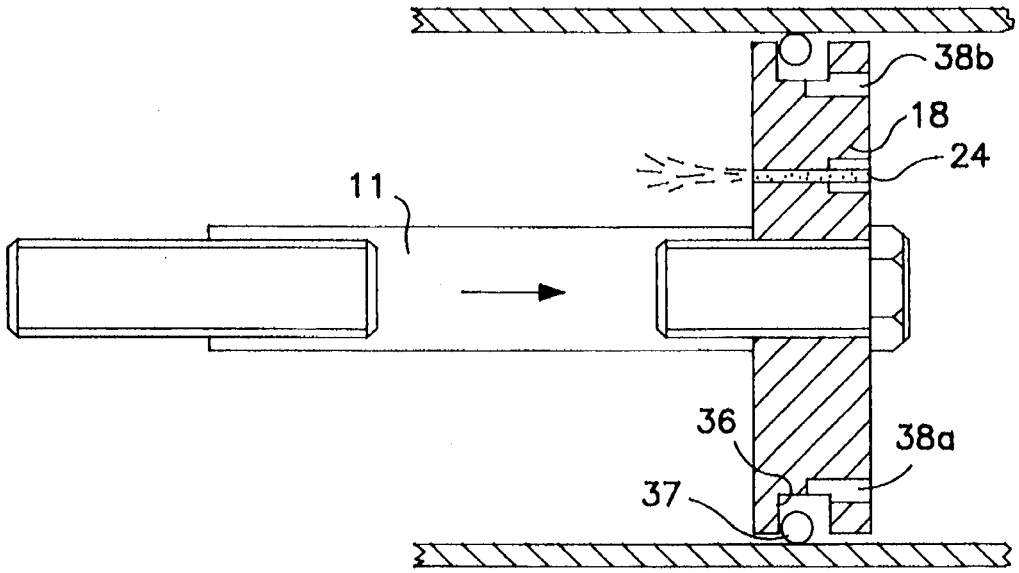
Figure 6B:
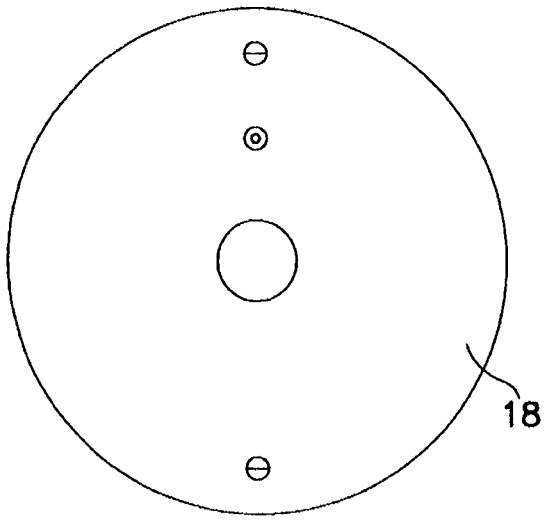
Figure 6C:
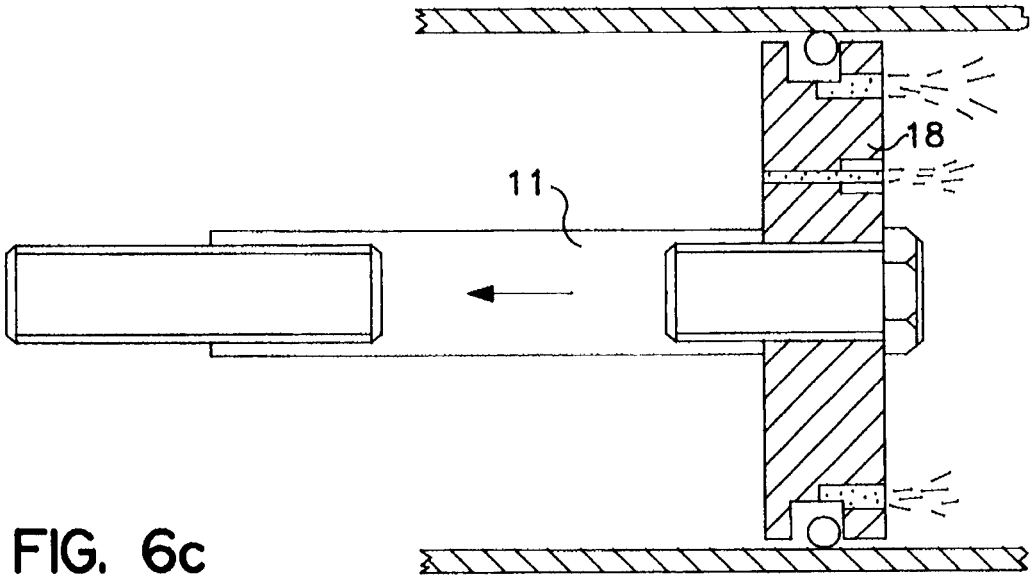
Figure 6D:
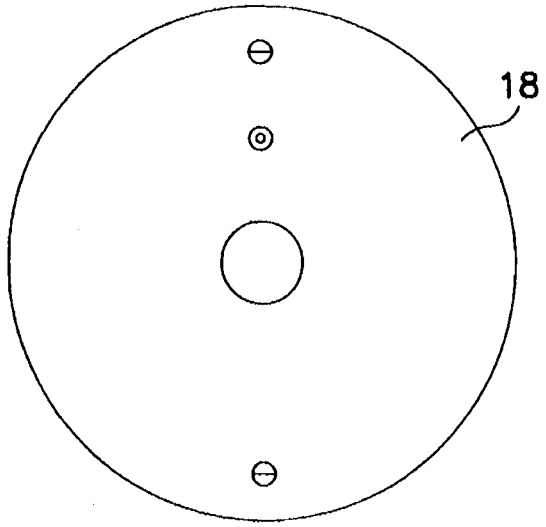
Figure 7:
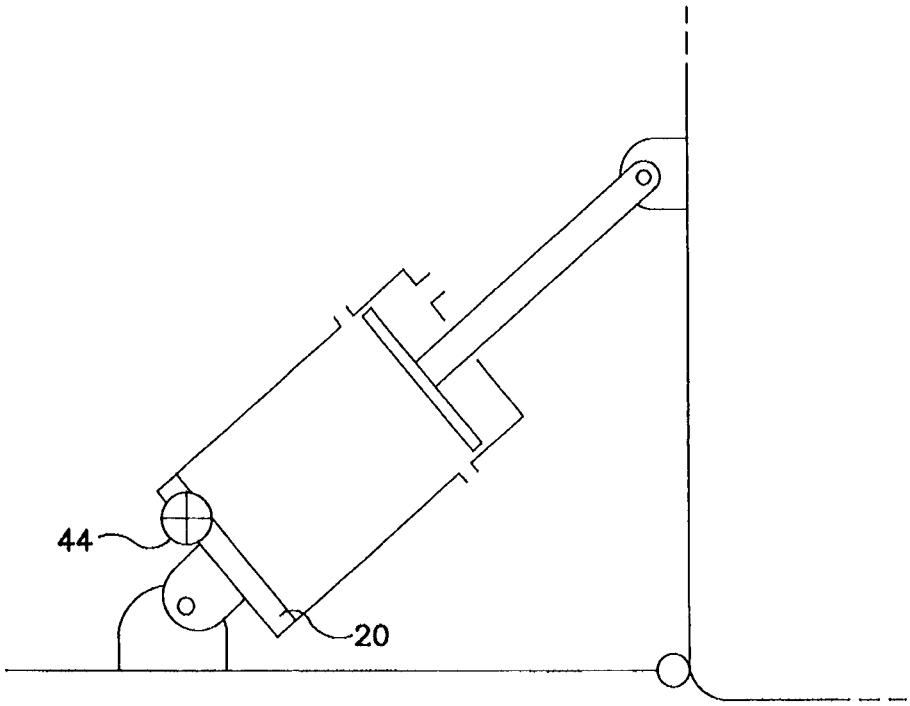
Figure 8:
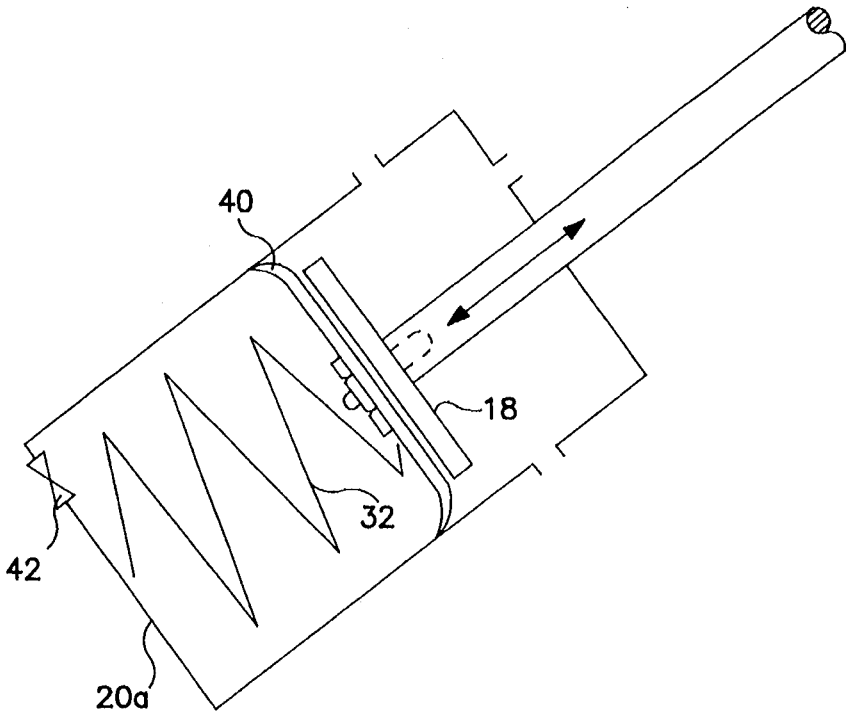

FIGS. 5*a* to 5*d* are diagrammatic longitudinal sectional views through the trimming device of FIG. 1 showing a ram part of the device in different operation conditions;

FIGS. 6*a* and 6*b* are diagrammatic longitudinal and end views illustrating the one-way valve operation of the piston head of the trimming device of FIG. 1 in its compression stroke;

FIGS. 6*c* and 6*d* are diagrammatic longitudinal and end views illustrating the one-way valve operation of the piston head of the trimming device of FIG. 1 in its fast-return stroke;

FIG. 7 is a diagrammatic sectional view illustrating one possible position of an infinitely adjustable control valve; and FIG. 8 is a diagrammatic sectional view illustrating an alternative form of one-way valve for the ram which uses a flexible skirt.

Referring to FIG. 1, a first embodiment of a trimming device in accordance with the invention comprises a generally planar trim tab 2, which may be formed for example from steel sheet, the trim tab 2 carrying a hinge 8 by which the trim tab 2 can be attached, in use, to the transom 4 of a hull 6 of a vessel. When so fitted, the trim tab 2 can be rotated about the hinge 8 so as to vary the angle of inclination of the trim tab 2. The "angle of inclination" referred to herein is the angle between the lower surface of the trim tab 2 and the longitudinal axis (not shown) of the water borne vessel to which it has been attached.

Rotation of the trim tab 2 about the hinge 8 is controlled by means of an extensible control mechanism 9 comprising a ram 11 and a cylinder 12. The upper end of the ram 11 is adapted to be pivotedly attached to the transom 4 at a position above the pinned hinge 8, by means of a first rotary coupling 5 and the lower end of the cylinder 12 is pivotedly attached by a second rotary coupling 7 to a portion of the trim tab 2 remote from the pinned hinge 8, so that extension of the extensible control mechanism 9 causes an increase of the angle of inclination of the trim tab 2.

The ram 11 comprises, at a lower end thereof, a piston 18 which is slideably accommodated in the cylinder 12. In some embodiments, the piston 18 may form a watertight barrier within the cylinder and in other embodiments it may be so formed as to function as a one way valve, permitting water to flow past the piston 18 in a direction towards the lower end of the cylinder 12, but preventing water flowing in the opposite direction. The latter arrangement will be described further hereinafter in connection with FIG. 8. The embodiment of FIG. 1 uses a combination of these possibilities, namely a sealing arrangement which allows water to pass around the piston when the piston is moved in one direction but to prevent water from passing around the piston when the piston is moved in the other direction, coupled with a control valve in the piston which allows water to pass through the piston in either direction at a controlled rate.

The lower end of the cylinder 12 is closed by an end cap 20 which is coupled by the second rotary joint 7 to the portion of the trim tab 2 remote from the pinned hinge 8. The upper end of the cylinder 12 is closed by an end cap 26 having a central hole 27 through which the ram 11 slidably extends and an offset hole 28 for the passage of water into and out of the cylinder. A port 28 penetrates the upper end cap 26 so that water may flow into or out of the cylinder 12 through this upper end cap 26 at a controlled rate.

In addition, a pair of diametrically opposed, transverse ports 30, which penetrate the longitudinal wall of the cylinder 12, provide a further route for water to flow into or out of the cylinder at a controlled rate.

A helical return spring 32 is compressed between the lower end cap 20 and the piston 18, urging the extensible control mechanism 9 to assume an extended state, corresponding to the condition shown in FIG. 1.

The piston 18 contains a through-bore 24 for the controlled passage of fluid (normally water) through the piston. The cylindrical edge surface 35 of the piston contains an annular groove 36 in which is disposed a resilient O-ring 37, for example made of rubber. The O-ring 37 is dimensioned so that is does not occupy the whole of the groove 36 and it is therefore capable of limited displacement therewithin in the longitudinal direction of the mechanism 9. The front surface of the ram facing the spring 32 also contains two semi-blind bores 38*a*, 38*b*, which communicate over approximately 50% of their inner ends with the annular groove 36 and which co-operate with the groove 36 and O-ring 37 to control the passage of water around the piston as described in detail hereinafter with reference to FIGS. 5*a* to 5*d*.

Figure 2:
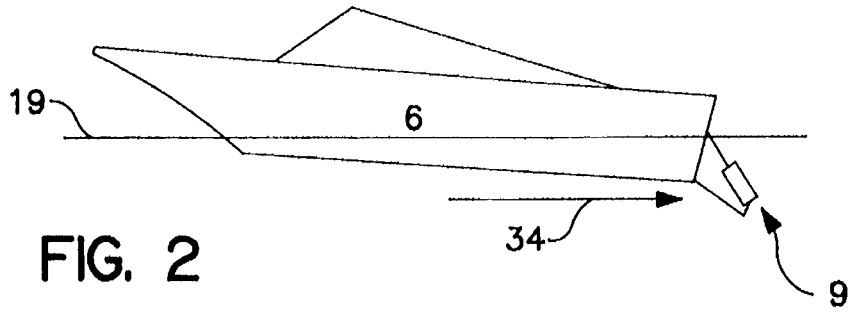
FIG. 2 is a side view of the vessel hull with the trimming device of FIG. 1 mounted on the transom thereof and with the vessel in a stationary condition in the water.

FIG. 2 shows one possible installation position for the trimming device on the vessel hull 6. It will be apparent that when the trim tab 2 is angled downwards, as in FIG. 2, and the vessel moves forwards, the trim tab 2 will meet water flowing over the vessel hull at a large angle of attack and so generate lift at the stern. The water level 19 is above the top of the cylinder—i.e. the cylinder is submerged.

Commonly, two movable trim tabs 2 will be used, with one on either side of, for example, an outboard motor or rudder which is at the center of the transom 4.

The method of operation of the above described embodiment of the invention will now be described with reference to FIGS. 1 to 6.

Figure 1A:
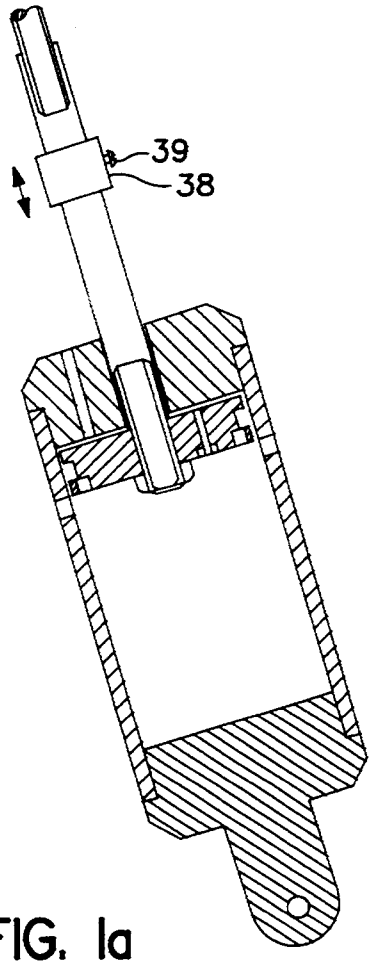
Figure 5A:
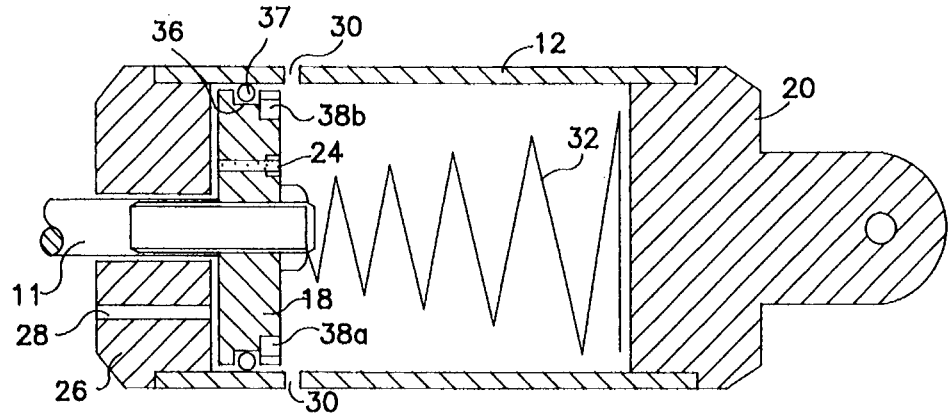

The initial state of the trimming device is as shown in FIGS. 1, 2 and 5*a*. This is the state assumed by the trimming device when the vessel is at rest, i.e. when no substantial external force is exerted on the trim tab 2. In this state, the helical return spring 32 holds the extensible control mechanism 9 in its extended position, so that the trim tab 2 is angled downwards. In this position, the piston 18 lies substantially against the top plate 26 of the ram, unless constrained otherwise by the stop device 38 described hereinafter in connection with FIG. 1*a*.

When the water borne vessel begins to move forward, a net force is exerted on a front face of the trim tab 2 by water flowing thereover, as represented by arrow 34 in FIG. 2. This force 34 urges the trim tab 2 to pivot upwards, tending to reduce its angle of inclination.

As a result of this force 34, the cylinder 12 is caused to be displaced upwards relative to the piston 18 so that the piston begins to move away from the upper end cap 26, against the restoring force of the helical spring 32. The initial relative movement of the piston and cylinder causes water to be ejected from the cylinder via the transverse holes 30. As the piston moves beyond the holes 30 it encounters a hydraulic block.

Figure 5B:
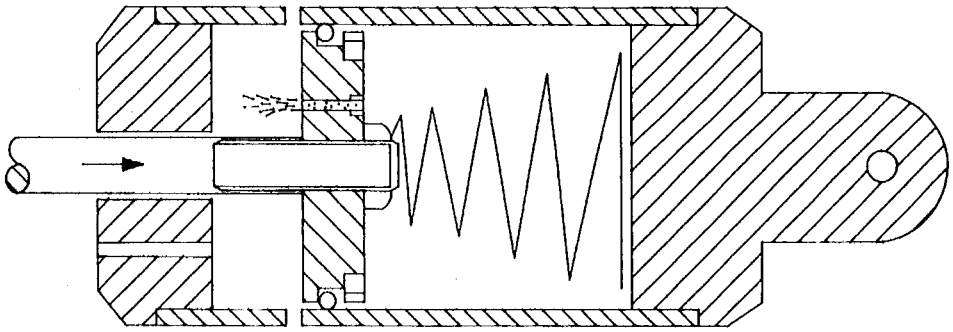
Figure 5C:
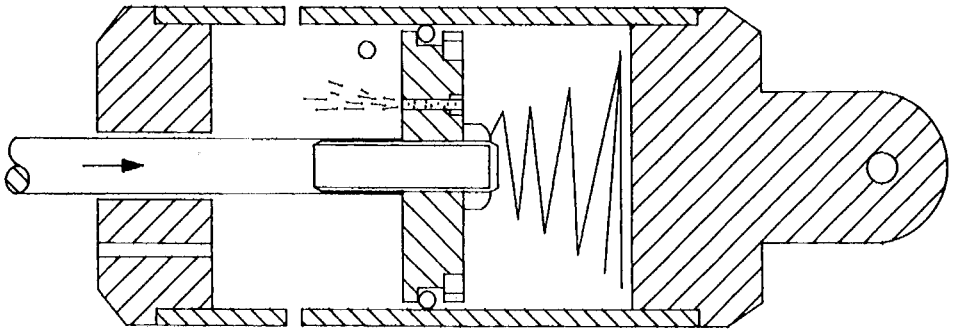

As indicated in FIGS. 5*b*, 6*a* and 6*b*, as soon as this relative displacement of the piston and cylinder commences the hydraulic pressure within the right-hand part of the cylinder (as viewed in FIG. 5*b*) causes the O-ring 37 to engage and be compressed against the left-hand side of the peripheral groove 36 of the piston and the internal wall of the cylinder 12, thereby forming a seal which prevents the passage of water between the periphery of the piston and the cylinder wall.

The initial relative movement of the piston and cylinder causes water to be ejected from the cylinder via the transverse holes 30. However, once the piston has moved beyond the holes 30, it encounters a substantial hydraulic block wherein the only route by which water can pass the piston is via the piston hole 24 (FIG. 5*b*). The relative displacement of the cylinder and ram thus continues (FIG. 5*c*) at a controlled rate determined by size of the hole 24 (as well as by the spring rate of the spring 32 and the magnitude of the force 34) so that the control mechanism 9 becomes gradually compressed, for example over a typical period of about 8 seconds, This therefore allows the angle of inclination of the trim tab to be reduced at a controlled rate. A reduction of the angle of inclination causes a reduction in the amount of lift generated by the trim tab.

Figure 5D:
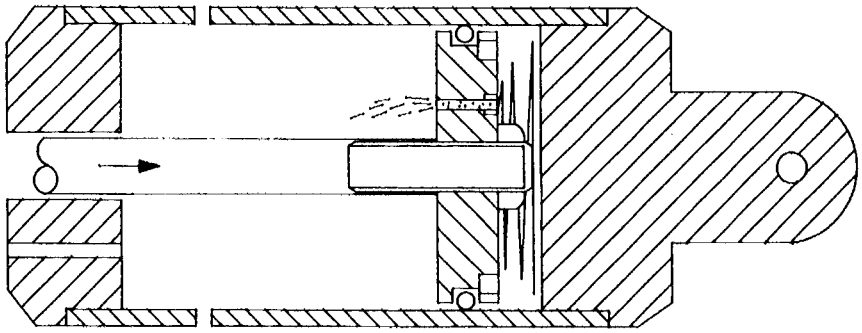

Eventually the piston approaches the lower end cap 20 (FIG. 5*d*), with the spring 32 fully compressed therebetween, the left-hand side of the cylinder as viewed in FIG. 5*d* then being full of water. In this condition, the extensible control mechanism 9 has reached a state of equilibrium in which the force of the helical return spring 32 is balanced by the force 34 exerted on the trim tab 2. As indicated in FIG. 5*d*, the spring may, if the force exerted on the trim tab is sufficiently large, be compressed to its fullest extent so that no further upward movement of the trim tab is possible.

When the vessel slows down and stops, the water force 34 exerted on the trim tab 2 is relieved, and the unbalanced force of the helical return spring 32 extends the control mechanism 9 in a direction to return it to its initial state. During this return movement, the hydraulic situation at the periphery of the piston is reversed and (as shown in FIGS. 6*c*, 6*d*) the O-ring 37 is displaced to the opposite side of the peripheral groove 36 whereby water can cross the piston via the bores 38*a*,38*b*, the groove 36 and the annular gap between the piston periphery and the inner wall of the cylinder, as well as via the bore 24. Furthermore, the presence of the transverse apertures 30 in the cylinder wall enables water to be forced out of the cylinder quickly. These provisions enable the spring 32 to return the piston and cylinder to the initial state of FIGS. 1 and 5*a* very quickly as soon as the force 34 is removed or substantially reduced.

The effect of the above-described automatic adjustment of the trim tab on the vessel is as follows.

When the vessel has just begun to move forwards, the angle of inclination of the trim tab 2 is large so that it generates a large amount of lift at the stern.

As the vessel accelerates, the trim tab 2 is forced upwards as described above, but its upward motion is retarded by the extensible control mechanism 9, so that while the vessel is accelerating, the trim tab 2 continues to generate lift, promoting planing and maintaining the correct attitude.

Figure 3:
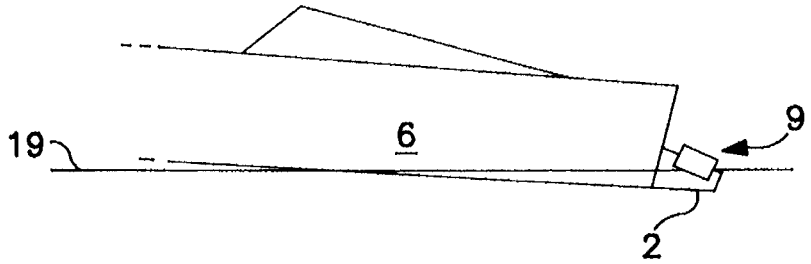
FIG. 3 is a simplified side view, corresponding to FIG. 2 but showing the trimming device of FIG. 1 at a later stage in its operation when the vessel is planing.

Eventually, if the boat reaches a high enough speed, it will be planing and the trim tab will have reached the equilibrium state shown in FIG. 3. At this time, the angle of inclination of the trim tab 2 will be small, so that the drag created by the flap is minimised. Many vessels require no lift at the stern to maintain the correct attitude once they are planing, so that it is most efficient for the trim tab 2 to be substantially horizontal in this condition.

Some vessels, however, will operate more efficiently if lift continues to be generated when the vessel is planing. To provide for this, upward motion of the trim tab 2 may be limited by the provision of a limiting collar 38 disposed around the ram 11 (see FIG. 1*a*). The limiting collar 38 limits compression of the extensible control mechanism by abutting against an outer face of the upper end cap 26. Its longitudinal position on the ram 11 is adjustable (it may, for example, be lockable by means of a screw 39) so that a minimum angle of inclination of the trim tab 2 can be adjustably set.

It will be appreciated that for the trim tab to operate optimally, the rate at which the trim tab 2 rises should be chosen to be appropriate to a particular vessel. This rate depends on the size of the port 24, (as well as, e.g. the size of the trim tab and the speed of the vessel). It is therefore desirable for the port 24 to be adjustable in order to enable the device to work with a wide range of vessels. This can be achieved by making the port 24 infinitely variable by means of a screw insert providing variable constriction of the port. Alternatively, and more preferable in practice, is to provide for a discrete range of port diameters. This can be achieved by, for example, providing a range of piston heads 26 each containing a different size of port 24, or several such ports. Another way in which this can be achieved is to mount over one end of the port 24 a rotary plate containing several different sized holes which can be selectively aligned with the port 24 to vary the effective size thereof.

Figure 4:
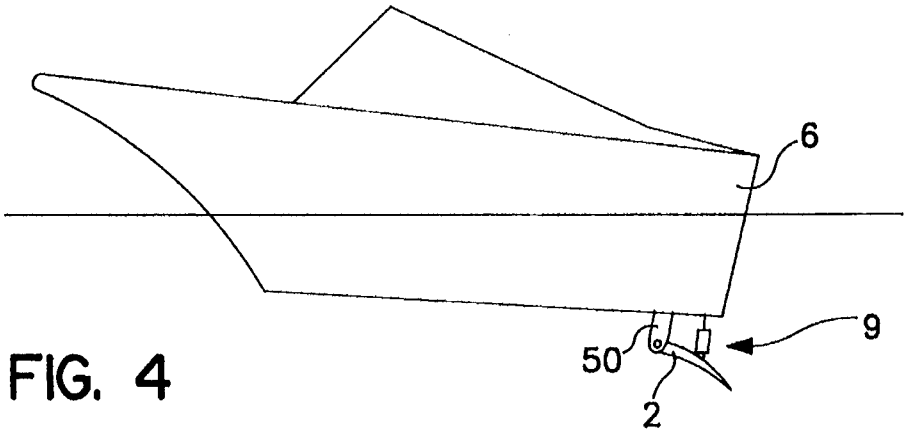
FIG. 4 shows a trimming device in accordance with the invention mounted in an alternative manner on a vessel.

The form of the trim tab, and its point of attachment to the hull, may be varied to adapt the invention to various types of water borne vessel. For example, an alternative form of the trim tab is shown in FIG. 4. In this embodiment the trim tab 2 is pivotally mounted on downwardly extending struts 50 which are rigidly connected to the hull 6. The trim tab has an asymmetric cross section to increase the amount of lift generated as it moves through the water, and is connected to and controlled by the extensible control assembly 9 as hereinbefore described.

As indicated in FIG. 1, it is advantageous for the length of the ram rod 11 to be adjustable so that the initial inclination of the trim tab 2 can be preset, either before the mechanism is attached to the vessel hull or when it is in situ. This can be achieved by forming the ram rod 11 in two interconnected coaxial components, the outer one 11*a* of which is internally threaded and the inner one 11*b* of which is externally threaded. As shown in FIG. 1, the outer rod component 11*b* is coupled to the piston head 18 and can therefore be rotated relative to the inner rod part 11*a* which is axially non-rotatable when in situ as a result of its fixture to the hull 6 via the rotary coupling 5. Adjustment of the length of the ram rod 11 can thus be achieved simply by rotation of the outer part 11*b* on the inner part 11*a*. A lock nut 46 can be tightened to secure the adjusted position.

FIG. 8 shows an alternative piston structure wherein a solid piston head 18a carries a flexible skirt 40 which engages the inner wall of the cylinder. A variable outlet port 42 is disposed in the lower end cap 20*a* of the cylinder. The orientation of the skirt 40 is such that when the relative movement of the piston and cylinder acts to compress the spring 32, the skirt is forced by the hydraulic pressure in the lower part of the cylinder against the wall of the cylinder. However, when the movement is in the opposite direction, the skirt tends to leave the wall at the cylinder and allow water to pass over it, and hence pass across the piston.

FIG. 7 shows a still further embodiment, using a one-way valve arrangement such as that shown in FIG. 1 or FIG. 8 but wherein the hole 24 in the piston is replaced by a variable hole 44 in the end cap 20 of the cylinder.

Although only trim tabs/flaps mounted at the stem of a water borne vessel have been described, it would be possible to provide flaps virtually anywhere along the length of a water borne vessel, if needed to promote planing and to maintain the correct attitude.

Whereas in the above described embodiments, the cylinder and piston unit operate using the surrounding water as the working fluid, the cylinder and piston could alternatively be designed as a closed unit in which case the working fluid could be something other than water, e.g. oil.

We claim:

1. A trimming device for a water borne vessel having a longitudinal axis, said trimming device comprising:

a trim tab;

means enabling said trim tab to be pivotally mounted to a vessel so as to be at least partially submerged in use; and a control mechanism which is coupled pivotally to said trim tab and is adapted to be coupled also to said vessel, said control mechanism comprising biasing means acting on said trim tab in such a way that when the vehicle is at rest, said biasing means cause said trim tab to adopt an initial inclination relative to said longitudinal axis of said vessel such that, upon forward motion of the vessel, said trim tab is subjected to pressure by water flowing over it which results in lift on the vessel;

said control mechanism further comprising motion retarding means automatically allowing said inclination of said trim tab relative to said longitudinal axis of said vessel to reduce gradually at a controlled rate under the influence of said pressure.

2. A trimming device according to claim 1 wherein said control mechanism comprises a cylinder and a ram, said ram comprising a piston which is slideably accommodated in the cylinder.

3. A trimming device according to claim 2, including a helical compression spring means disposed in said cylinder between a stop means adjacent one end of the cylinder and one side of said piston, such as to act to increase the angle of inclination of said trim tab when the pressure of water flowing over said tab is less than the force exerted by said spring means.

4. A trimming device according to claim 3, wherein said cylinder contains at least one port by which surrounding liquid can flow into and out of said cylinder.

5. A trimming device according to claim 4, wherein said at least on port is located at one end of said cylinder.

6. A trimming device according to claim 4, wherein said at least one port is located in a side wall of said cylinder.

7. A trimming device according to claim 2, wherein one end of said cylinder is joined to said trim tab by a first rotary joint means and said ram is coupled to a second rotary joint means which is adapted to be connected to said vessel.

8. A trimming device according to claim 7, wherein a helical spring means is disposed within said cylinder between said ram piston and said one end of the cylinder, said ram piston including a one-way valve means by which liquid is prevented from flowing around the piston when the piston is displaced within the cylinder in a first direction to compress said spring but by which liquid is allowed to flow around the piston when the piston is displaced within the cylinder in a second opposite direction.

9. A trimming device according to claim 8, including transverse port means in the cylinder adjacent an end of said cylinder opposite to said one end, for the flow of liquid into and out of the cylinder.

10. A trimming device according to claim 9, including at least one port in an end wall of said cylinder opposite to said one end thereof.

11. A trimming device according to claim 8, wherein said one way valve means in the piston comprises a peripheral groove in said piston, an annular sealing means within said peripheral groove and at least one generally longitudinal bore in the piston which communicates with said peripheral groove such that in said first direction of the piston said sealing means engages against a wall of the groove and an inner wall of the cylinder to prevent the passage of liquid between said piston and said cylinder wall but in said second direction of the piston, a passage exists across said piston via said longitudinal bore and said peripheral groove.

12. A trimming device according to claim 8, wherein said one-way valve means in the piston comprises a flexible, cup-shaped skirt which is urged against an inner wall of the cylinder by hydraulic pressure when the piston is displaced in said one direction but which is flexibly distorted away from said cylinder wall by hydraulic pressure when the piston is displaced in said other direction.

13. A trimming device according to claim 8, wherein the piston contains at least one aperture for the passage of liquid through the piston at a controlled rate.

14. A trimming device according to claim 8, including at least one port in said one end of said cylinder for the passage of liquid out of the cylinder at a controlled rate.

15. A trimming device according to claim 1, wherein said trim tab is in the form of a generally planar member.

16. A trimming device according to claim 1, wherein said trim tab is in the form of a foil which generates lift by virtue of its cross section.

17. A trimming device for a water borne vessel having a longitudinal axis, said trimming device comprising:

a trim tab;

means enabling said trim tab to be pivotally mounted to a vessel so as to be at least partially submerged in use; and a control mechanism which is coupled pivotally to said trim tab and is adapted to be coupled also to said vessel, such that said trim tab adopts an initial inclination relative to said longitudinal axis of said vessel whereby, tip on forward motion of the vessel, said trim tab is subjected to pressure by water flowing over it which results in lift on the vessel;

said control mechanism comprising means automatically allowing said inclination of said trim tab relative to said longitudinal axis of said vessel to reduce gradually under the influence of said pressure, said control mechanism comprising a cylinder and a ram, said ram comprising a piston which is slidably accommodated in the cylinder, a spring being disposed in the cylinder between a stop at one end of the cylinder and one side of said piston, such that said spring increases the angle of inclination of said trim tab when the pressure of water flowing over said trim tab is less than the force exerted by said spring, said cylinder containing at least one port for permitting liquid to flow into and out of said cylinder.

18. A trimming device for a water borne vessel having a longitudinal axis, said trimming device comprising:

a trim tab;

means enabling said trim tab to be pivotally mounted to a vessel so as to be at least partially submerged in use; and a control mechanism which is coupled pivotally to said trim tab and is adapted to be coupled also to said vessel, such that said trim tab adopts an initial inclination relative to said longitudinal axis of said vessel whereby, upon forward motion of the vessel, said trim tab is subjected to pressure by water flowing over it which results in lift on the vessel;

said control mechanism comprising means automatically allowing said inclination of said trim tab relative to said longitudinal axis of said vessel to reduce gradually under the influence of said pressure, said control mechanism comprising a cylinder and a ram, said ram comprising a piston slidably accommodated in the cylinder, one end of said cylinder being joined to said trim tab by a first rotary joint, said ram being coupled to a second rotary joint connectable to said vessel, a spring disposed within said cylinder between said piston and one end of the cylinder, said piston including a one-way valve preventing liquid from flowing around the piston when the piston is displaced within the cylinder in a first direction to compress said spring, said one-way valve allowing liquid to flow around the piston when the piston is displaced within the cylinder in a second direction opposite to said first direction.

* * * * *